US007318562B2

(12) United States Patent
Biagiotti et al.

(10) Patent No.: US 7,318,562 B2
(45) **Date of Patent: *Jan. 15, 2008**

(54) REWINDING MACHINE AND METHOD FOR THE FORMATION OF LOGS OF WEB MATERIAL WITH MEANS FOR SEVERING THE WEB MATERIAL

(75) Inventors: Guglielmo Biagiotti, Lucca (IT); Eva Perini, San Michele Di Moriano (IT)

(73) Assignee: Fabio Perini, S.p.A., Lucca (IT)

( * ) Notice: Subject to any disclaimer, the term of this patent is extended or adjusted under 35 U.S.C. 154(b) by 0 days.

This patent is subject to a terminal disclaimer.

(21) Appl. No.: 11/208,629

(22) Filed: Aug. 23, 2005

(65) Prior Publication Data

US 2005/0279875 A1 Dec. 22, 2005

Related U.S. Application Data

(60) Division of application No. 10/404,150, filed on Apr. 2, 2003, now Pat. No. 6,948,677, which is a continuation of application No. 09/377,170, filed on Aug. 19, 1999, now Pat. No. 6,648,266, which is a continuation-in-part of application No. 08/501,072, filed on Oct. 3, 1996, now Pat. No. 5,979,818.

(30) Foreign Application Priority Data

Mar. 24, 1993 (IT) ..... FI93A0058
Mar. 23, 1994 (WO) ..... PCT/IT94/00031

(51) Int. Cl.
*B65H 35/10* (2006.01)

(52) U.S. Cl. ..... 242/521; 242/542.2

(58) Field of Classification Search ..... 242/521, 242/526, 526.1, 532.3, 542.2
See application file for complete search history.

(56) References Cited

U.S. PATENT DOCUMENTS 5,769,352 A * 6/1998 Biagiotti ..... 242/521
5,979,818 A * 11/1999 Perini et al. ..... 242/521
6,648,266 B1 * 11/2003 Biagiotti et al. ..... 242/521
6,948,677 B2 * 9/2005 Biagiotti et al. ..... 242/521

* cited by examiner

*Primary Examiner*—John Q. Nguyen
(74) *Attorney, Agent, or Firm*—Breiner & Breiner, LLC

(57) ABSTRACT

The rewinding machine for the formation of logs (L) of web material (N) wound on a core (A), includes a first winder roller (15) around which the web material (N) is fed, and a second winder roller (17) forming, with the first winder roller, a nip (19) through which the core (A) and the web material (N) pass. A web material-severing device (43) cooperates with the first roller (15). Located upstream of the nip (19), with respect to the direction of movement of the web material (N), is a surface (33) defining, with the roller (15), a channel (39) into which the core (A) is inserted. A conveyor (47; 57; 67) introduces a core into the channel (39). The material-severing device (43) cooperates with the roller (15) along the channel (39) between the region of insertion of a new core and the nip (19).

8 Claims, 7 Drawing Sheets

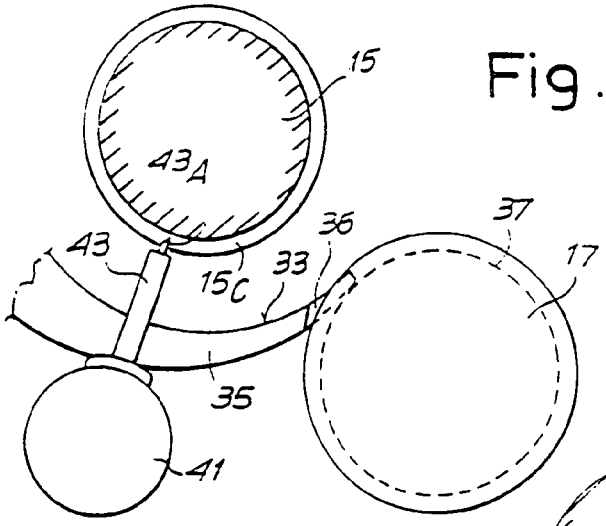
Fig. 10
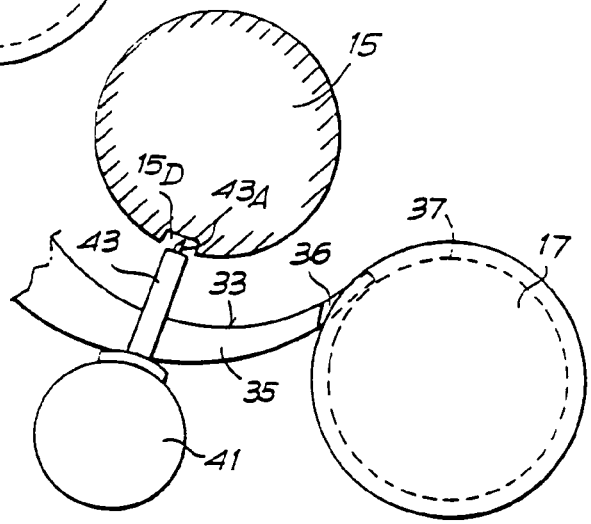
Fig. 11
Fig. 13
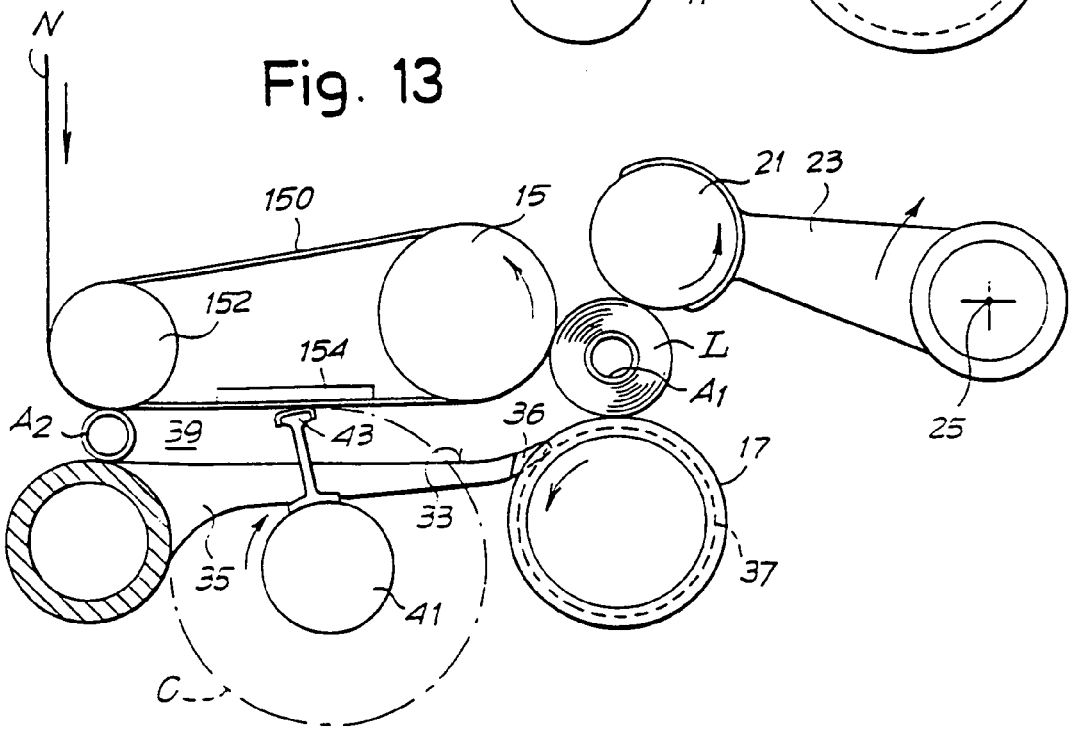

REWINDING MACHINE AND METHOD FOR THE FORMATION OF LOGS OF WEB MATERIAL WITH MEANS FOR SEVERING THE WEB MATERIAL

RELATED APPLICATION

This application is a division of Ser. No. 10/404,150 filed Apr. 2, 2003, now U.S. Pat. No. 6,948,677 which is a continuation of application Ser. No. 09/377,170 filed Aug. 19, 1999, now U.S. Pat. No. 6,648,266 B1, which is a continuation-in-part of U.S. Ser. No. 08/501,072 filed Oct. 3, 1996, now U.S. Pat. No. 5,979,818.

FIELD OF INVENTION

The invention refers to a surface rewinding machine and method for the formation of logs or rolls of web material wound on a central core. Such rewinding machines are well-known, described, for example, in U.S. Pat. Nos. 4,487,377; 4,723,724; 4,327,877 and 4,828,195; U.K. Patent No. 2,105,688; and in EP-A-0 498 039.

More in particular, the present invention refers to a rewinding machine which includes a first winder roller on which the web material is fed; a second winder roller defining, with the first winder roller, a nip through which the core and the web material pass; means for feeding the web material to the nip; means for introducing a core on which the web material is to be wound; and a web material severing means cooperating with the first winder roller.

BACKGROUND OF THE INVENTION

A rewinder of this type is described, for example, in U.S. Pat. No. 4,487,377.

These rewinders are used for producing smaller diameter logs or rolls of web material from large diameter parent rolls. Typically, these machines are used in the paper converting industry to produce rolls of toilet paper, kitchen towels, all-purpose wipers and the like. The formed logs may be as long as 350 cm and only 10-15 cm in outer diameter, and are subsequently cut transversely to their axis to obtain small rolls which may be only 10-30 cm long.

In the production of such logs, it is important to use reliable machines able to run at high production speeds (in the range of 600-1000 m/minute) which provide a consistently high-quality product, with uniform windings, especially of the first loops. The length of the material on each log must be presettable and maintained, from log-to-log, with great accuracy.

One way to obtain high production rates and a high quality of the manufactured product is shown in U.S. Pat. No. 4,487,377, which provides for a web-cutting member which cooperates with the first winder roller of the rewinder. The web material is cut upstream of the point where the core is introduced. After cutting, the leading edge of the web material adheres to the surface of the winder roller and is transferred (by the rotation of the latter) towards the winding region where the leading edge is made to adhere to a new core suitably introduced by an insertion means.

This machine requires means (for holding the leading edge of the web material onto the winder roller) which are housed inside the winder roller and which must be timely activated and deactivated to hold and release the edge at preset moments, thereby allowing the starting of the winding on a new core.

In U.S. Pat. No. 4,327,877 a machine is described, wherein the web is torn between the core and the second winding roller once the core has been introduced into the nip. Tearing is obtained by a suction means inside the second winding roller. The suction means forms a loop of web material which is pinced between the new core and the second roller.

OBJECTS OF THE INVENTION

A first object of the present invention is a rewinding machine which is able to produce a high quality finished product at high speeds with a simpler and more economical construction than that of known rewinders. A further object of the present invention is to provide a versatile rewinder able to produce logs of varying length without requiring complex mechanisms for adaptation to different lengths of web material without a slipping of the web material on the winder roller onto which it is fed. Another object of the present invention is the construction of a rewinder having means for tearing or cutting the web material, which means are reliable, simple, and inexpensive to produce and maintain.

These and further objects and advantages will appear evident to the skilled in the art by the following description.

BRIEF DESCRIPTION OF THE INVENTION

In the rewinder according to the present invention, a surface or track is provided upstream of the nip between the winder rollers, which defines, together with the web feeding means which feeds the web material into the nip, a channel into which the core is introduced. A web severing means cooperates with the web feeding means at an intermediate position along the channel between the region of insertion of the new core and the nip defined between the winder rollers.

According to the invention, a machine is provided wherein a core is inserted into a channel upstream of the nip between a first and a second winder roller. The web material is severed downstream of the core insertion region by severing means which cooperate with the first winder roller or other means for feeding the material into the nip. This avoids the need of accelerating one of the winder rollers, and the severed web material begins to wind up on the core while the core starts to roll into the channel and on the surface or track by the rotation of the first winder roller. In some cases, the web-feeding means may be a belt system combined with the first winder roller.

This arrangement allows a precise severance of the web material to be carried out by severing means which cooperate with the first winder roller, without having to hold the leading edge of the web material on the winder roller, inasmuch as at the moment of severance of the web material, the new core is already in contact with the web material. Furthermore, the un-tensioning of the web material upstream of the winding region is substantially eliminated.

If desired, the start of the winding of the web material around the core may be assisted by placing glue on the surface of the core, or by suitable air jet or vacuum or mechanical means. The use of glue ensures a more reliable operation and increases the quality of the final product.

The surface or track for the rolling of the core extends, substantially, from the position where the introduction means discharges the core, up to the nip between the two winder rollers. To make the transit of the core from the non-moving surface or track to the second rotating winder roller easier, the surface is preferably comb-shaped, at least in the terminal portion thereof. This comb-like terminal portion cooperates with annular slots in the second winder roller to allow the core, having the first turns of web material wound thereon, to be transferred smoothly and without shocks or strains to the nip between the winder rollers.

In practice, since the extension of the track surface on which the core rolls (prior to the insertion thereof into the nip) is relatively short, and the web material very thin, any increase in diameter due to the winding of the first turns is insignificant. Accordingly, the track or fixed surface can define, together with the cylindrical surface of the first winder roller, a channel of substantially uniform cross-section and, advantageously, of a height slightly lower than the diameter of the core. The difference between the height of the channel and the diameter of the core causes the latter to be slightly squeezed when initially inserted thereinto, and this advantageously allows the web material to adhere to the core while facilitating the rotational acceleration of the core.

In practice, the severing means are so constructed as to be able to move along a cylindrical path which is almost tangent to the cylindrical surface of the first winder roller, or slightly interfering therewith. The peripheral speed of the cylindrical surface of the first winder roller and of the web material carried thereon is different than the tangential speed of the severing means along the path. In this way, when the web material is pinched between the severing means and the cylindrical surface of the first winder roller, the difference in speed causes a slight retardation of the web material and thus the tearing thereof. The rotational speed of the unit which carries the severing means is precisely controlled. Perforation lines on the web material adjacent the severing means will facilitate the tearing of the web material.

In order for the severing means to enter in contact with the web on the cylindrical surface of the first winder roller at an intermediate position along the channel, (while the rotary unit carrying the severing means is arranged outside the channel), the severing means pass through slots or apertures in the track. Thus, by controlling the rotational speed of the unit, the severing means moves out of the channel ahead of the core which is passing therethrough. The apertures or slots in the track may be obtained, for example, by providing a plurality of strips parallel to one another in the direction of advancement of the web material. The distance between the strips is sufficient to allow the passage of the severing means.

In order to increase the versatility of the machine and simplify the construction of the web material severing means, in a preferred embodiment of the rewinder, the severing means are made in the form of pressers or pads (resilient, if required) which press against the surface of the first winder roller, or other material feeding means, to pinch the web material. Advantageously, to make the tearing of the web material easier, in the regions where the pressers act against the roller, the surface of the first winder roller may have a low coefficient of friction. To this end, the first winder roller may be provided with a surface having wide annular bands suitably polished, having a low coefficient of friction, and separated by narrow annular strips having a high coefficient of friction. This ensures the proper friction on the web to properly feed the web, in particular at the moment when the new core is rotationally accelerated. The annular strips with high coefficient of friction may be aligned with the strips which define the track or core rolling surface.

With the arrangement above described, the length of the material wound into each individual log may be pre-determined and accurately controlled, regardless of the diameter or circumference of the first winder roller, inasmuch as there is no need for coordinating the position of the severing means with a particular portion of the surface of the winder roller, as is the case in the prior art machines.

Similar results in terms of versatility are attained if the severing means are provided with blade portions (saw-toothed, if required) which cooperate with annular channels in the first winder roller. Blade means could operate with a longitudinal slot instead of annular channels.

The unloading from the winder of a completed log or roll may take place by an accelerating third, diameter-control, roller disposed downstream of the first and second winder rollers, in a manner similar to that described in the above-mentioned GB-A-2,105,688. However, provision may also be made for the completed log to be unloaded by deceleration of the second winder roller, while keeping the peripheral speed of the third winder roller constant and substantially equal to the peripheral speed of the first winder roller. The deceleration of the second winder roller also causes the core to go through the nip defined by the first and second winder rollers.

It is not excluded that the core passes through the nip between the first and second winder, rollers by means of a small and constant difference in the peripheral speed between the two winder rollers. In this case, it may be necessary to provide a relative mobility of the first and second winder rollers.

When provision is made for a deceleration of the second winder roller in order to unload the completed log and/or to allow the passage of the core through the nip, an actuator means may be provided which causes both the deceleration of the roller and the actuation of the web material severing means. This is possible because the latter will have to be operated only when a log has been completed and a new core has to be introduced, i.e., when the deceleration of the second winder roller is necessary. This greatly simplifies the structure of the machine.

With the above and other objects in view, further information and a better understanding of the present invention may be achieved by referring to the following detailed description.

BRIEF DESCRIPTION OF THE DRAWINGS

For the purpose of illustrating the invention, there is shown in the accompanying drawings a form thereof which is at present preferred, although it is to be understood that the various instrumentalities of which the invention consists can be variously arranged and organized, and that the invention is not limited to the precise arrangement and organizations of the instrumentalities as herein shown and described.

In the drawings, wherein like reference characters indicate like parts:

FIGS. 10 and 11 show two embodiments of the web material severing means in a schematic side view;

FIG. 13 shows a modified embodiment of the invention wherein a belt is additionally combined to the first winder roller.

DETAILED DESCRIPTION AND PRESENTLY PREFERRED EMBODIMENT

Figure 1:
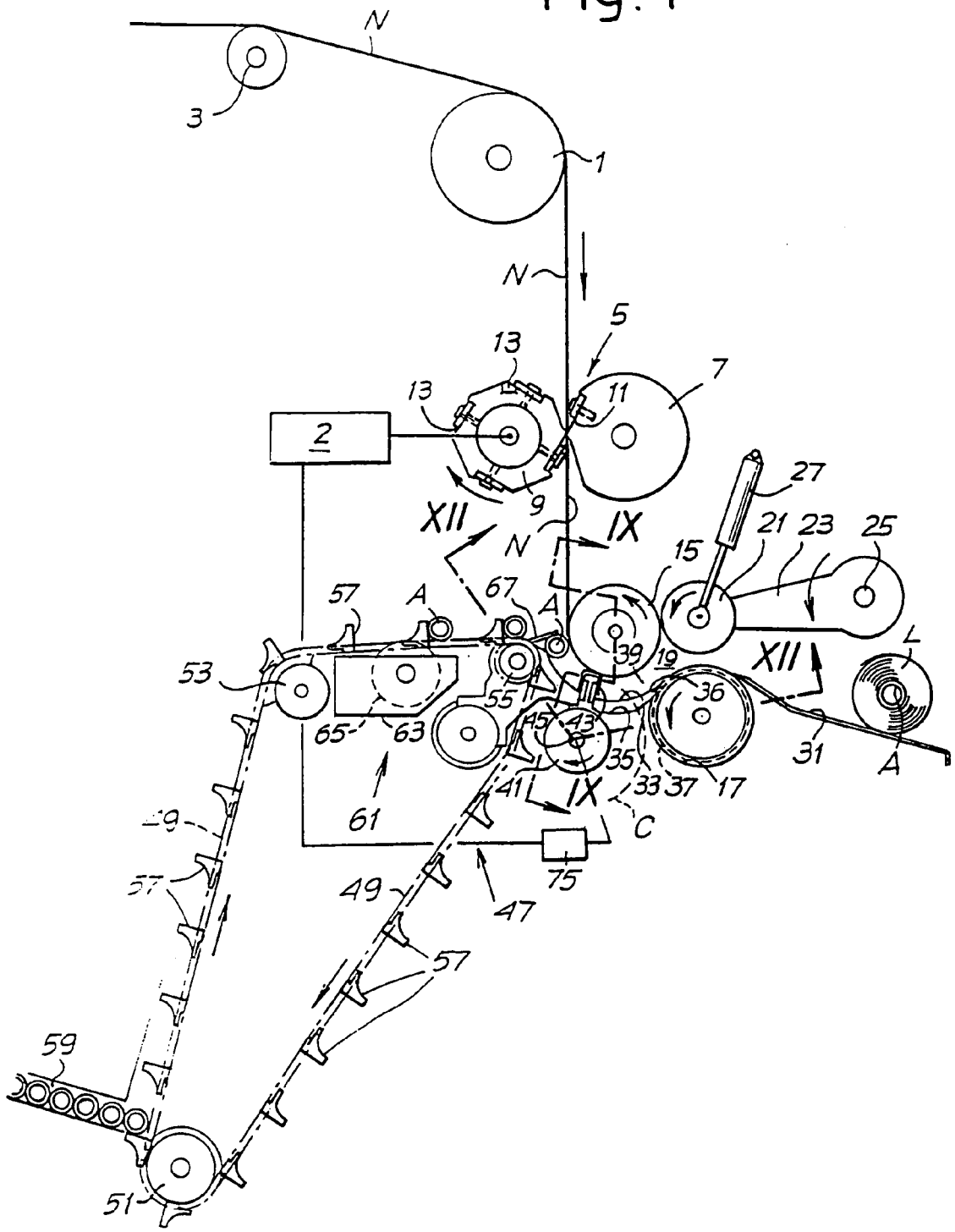
FIG. 1 shows a schematic side view of the rewinder according to the invention.

The basic elements of the rewinder will be described hereinafter by referring first to FIG. 1. Reference numerals 1 and 3 indicate rollers around which the web material N is fed from a supply parent roll (not shown) to the winding region of the rewinder. The web material N is fed through a perforation group, generally shown at 5, including a non-rotating support 7 and a rotating cylinder 9. The support 7 carries a counter-blade 11 which cooperates with blades 13 carried by the cylinder 9 to provide a line of perforations across the web.

Located downstream of the perforation group 5 are a first winder roller 15, around which the web material is fed, and a second winder roller 17. In the illustrated example, the two rollers 15 and 17 each rotates in a counter-clockwise direction. The cylindrical surfaces of rollers 15 and 17 define a nip 19 through which the web material N is fed. Numeral 21 designates a third roller also rotating in a counter-clockwise direction and supported by an arm 23 pivoted at 25 to the machine frame. The arm 23 can oscillate to allow the roller 21 to be lifted and lowered by an actuator 27. The winder rollers 15, 17 and 21 define the region where the winding of each log is completed, according to the procedures to be described hereinafter.

Located downstream of the three winder rollers is a chute 31 along which the completed logs L roll for the transfer thereof towards tail gluer means, not shown.

Figure 9:
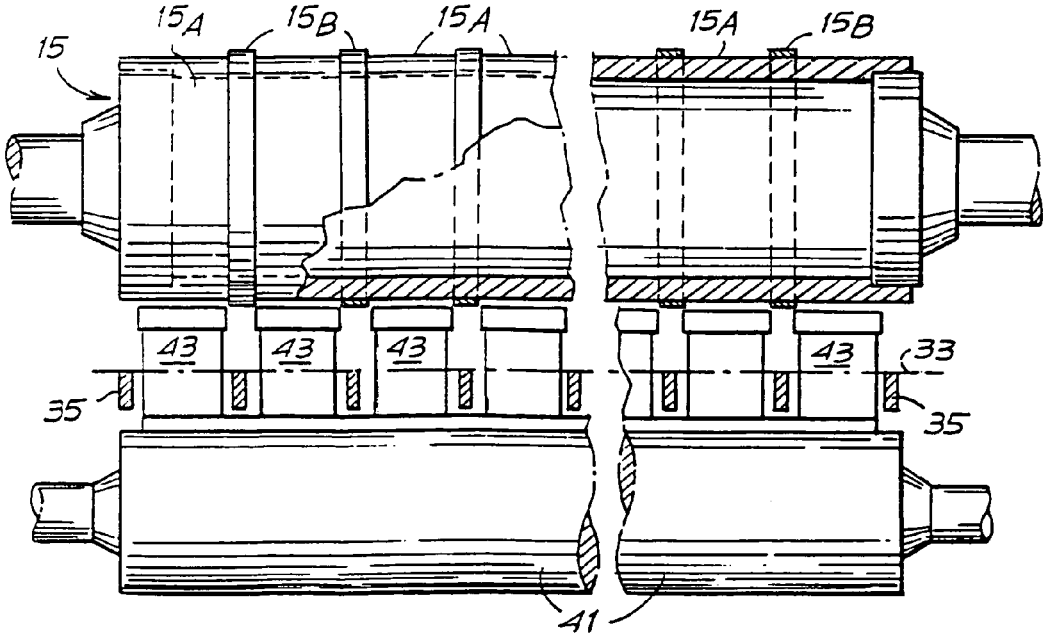
FIG. 9 shows a section taken along line IX-IX of FIG. 1.

Disposed upstream of the nip 19 is a curved surface or track 33 defined by a series of parallel arcuate strips 35 (FIG. 9). The strips 35 have pointed ends 36 directed toward the nip 19 and which terminate in annular slots 37 of the lower winder roller 17. (See FIGS. 10, 11 and 12). At the opposite end, the strips 35 terminate near the region at which the introduction of the cores A takes place, the latter being fed and inserted in the manner described hereinafter.

The curved surface or track 33 and the cylindrical surface of the first winder roller 15 define a channel 39 for the passage of the cores A. The cross-section, i.e., the dimension of the channel 39 measured perpendicularly to the track 33, may be substantially uniform along the length of the strips and advantageously equal to, or slightly less than the diameter of the cores being used. This is achieved because the surface of the track 33 has a constant radius of curvature with its axis coincident with the axis of the winder roller 15.

Arranged below the strips 35 which define the surface 33 is a rotary unit 41 carrying means 43, for the severance of the web material, which cooperate with the cylindrical surface of the winder roller 15. In this embodiment, the severing means includes pressers or pads 43 intended to exert a pressure, through a slight interference, against the surface of the roller 15. The unit 41 is made to rotate intermittently, in the illustrated example, in a clockwise direction. The pressers 43 move along a circular path C which has an axis coincident with the axis of rotation 45 of the unit 41 and almost tangent to (or making a slight interference with) the cylindrical surface of the winder roller 15.

The cores are introduced into the channel 39 by means of a conveyor generally shown at 47 (see FIG. 1). The conveyor includes a flexible continuous member 49 made up, for example, of a chain or a belt driven around transmission wheels 51, 53, 55, one of which is motor-driven. Disposed at regular intervals on the flexible member 49 are pushers 57 each of which picks up a core from a container 59. The cores A are removed by the pushers 57 and lifted and transferred, through a gluing unit, generally shown at 61, which may include a tank 63 of glue in which a series of discs 65 rotate. Such gluers are well-known and need not be described in greater detail.

In FIG. 1 only a few cores A are shown, but it is to be understood that, under proper operating conditions, a respective core A is carried by each pusher 57 from the container 59, across the wheel 51 to the wheel 55, close to the mouth of the channel 39, to start the winding of each log, as will be described hereinafter with reference to FIGS. 2 to 8.

Figure 2:
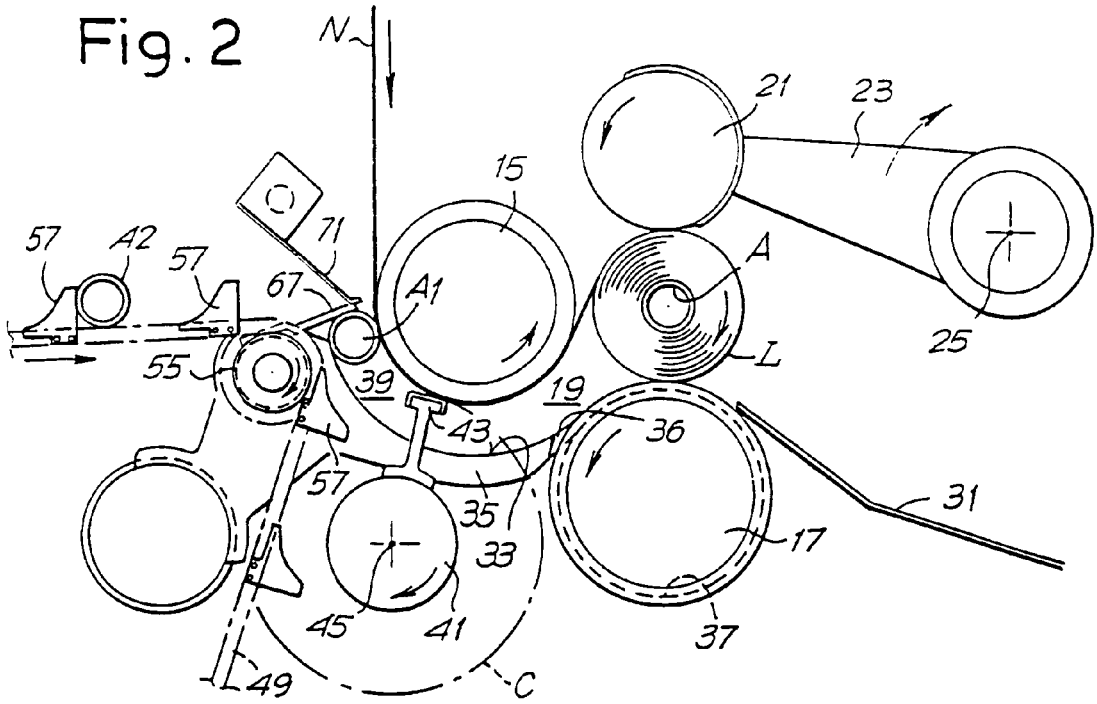
FIGS. 2 to 8 diagrammatically show successive working steps of the rewinder of FIG. 1.

FIG. 2 shows the final step of the winding of a log L. The first winder roller 15 and the third roller 21 rotate at a peripheral speed equal to the web material N feeding speed, while the second winder roller 17 rotates at a temporary lower peripheral speed to allow the completed log L to be moved towards the chute 31. At this stage, a new core A1 has been brought by the relevant pusher 57 to the entrance of channel 39. The insertion of the core A1 into the channel 39 may be carried out directly by the relevant pusher 57, or by an auxiliary pushing member, indicated by 67, rotating about the axis of wheel 55. The latter solution (shown in the illustrated example) allows the insertion of the core A to be performed with greater rapidity and precision, inasmuch as the insertion movement is unrelated to the movement of conveyor 47, the push member 67 being provided with an actuator which is independent of the actuator of the conveyor 47.

During this state, the rotary unit 41 rotates about its axis 45 and the pressers 43 have already entered the channel 39 by passing between the strips 35 which define the surface 33. The peripheral speed of pressers 43 is less than that of roller 15 and, therefore, also less than the speed of the web material N. In this way, the web material N is pressed between the two surfaces moving at different speeds. The effect of this difference in speed is slowing down of the pinched portion with respect to the rest of the web material. This slowing down causes the web material to tear along the perforation line which is closest to the point at which the web material N is pinched.

Figure 3:
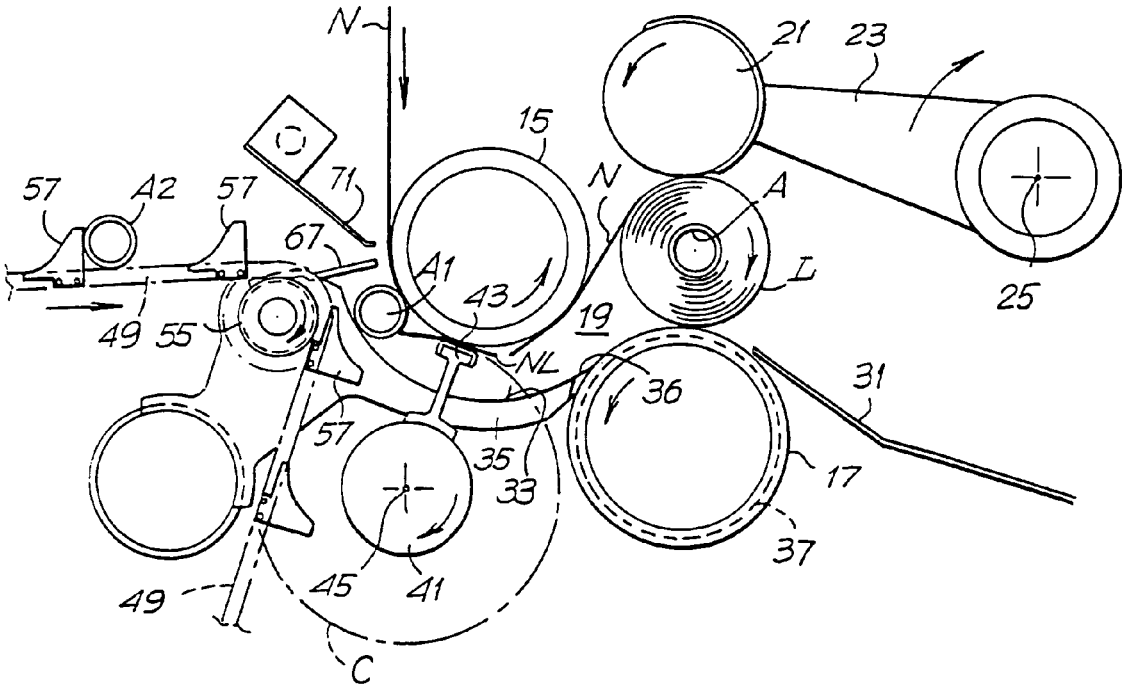

FIG. 3 shows the next stage in which the web material is torn off, giving rise to a new leading edge NL. The core A1 has, in the meantime, started to rotate owing to the contact thereof with the stationary surface 33 and with the rotating cylindrical surface of the winder roller 15. The core moves forward (i.e., downstream), therefore, by rolling along surface 33 at a speed equal to half the feeding speed of the web material N. The cross dimension of channel 39, which is slightly less than the diameter of the core A1 (the latter being typically made from pliable cardboard), allows a friction to be generated. This friction is necessary for the angular acceleration of the core from zero to the rolling speed, and the adhesion of the web material N to the surface of the core, on which glue has been spread by the gluing device 61. The latter effect is missing when the gluing of the core is not provided.

Figure 4:
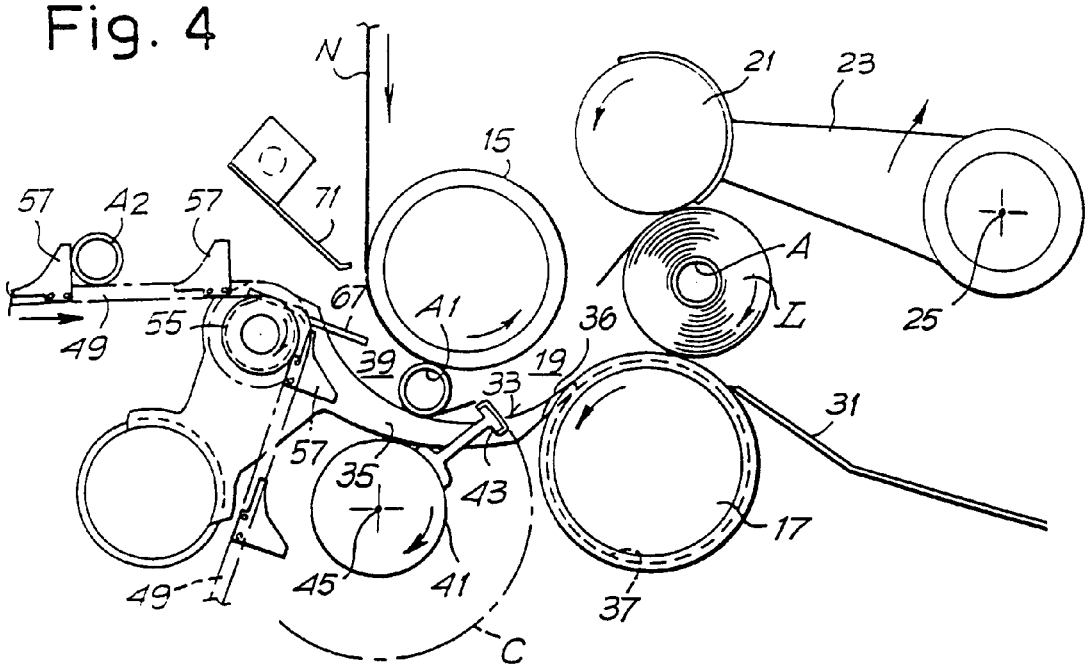

FIG. 4 shows the relative position taken by the core A and pressers 43 a few moments after severance of the web material N. The rotary unit 41 keeps on rotating at a speed lower than the web feeding speed, and also less than the advancing speed of core A1, so that a progressive approach of the core to the pressers 43 will take place. However, contact between core and pressers is avoided since a slight rotation of the rotary unit 41, causes the presser means to move out of the channel 39 through the spaces between the strips 35. This allows the core A1 to roll forward up to the nip 19 as shown in FIG. 5.

Figure 5:
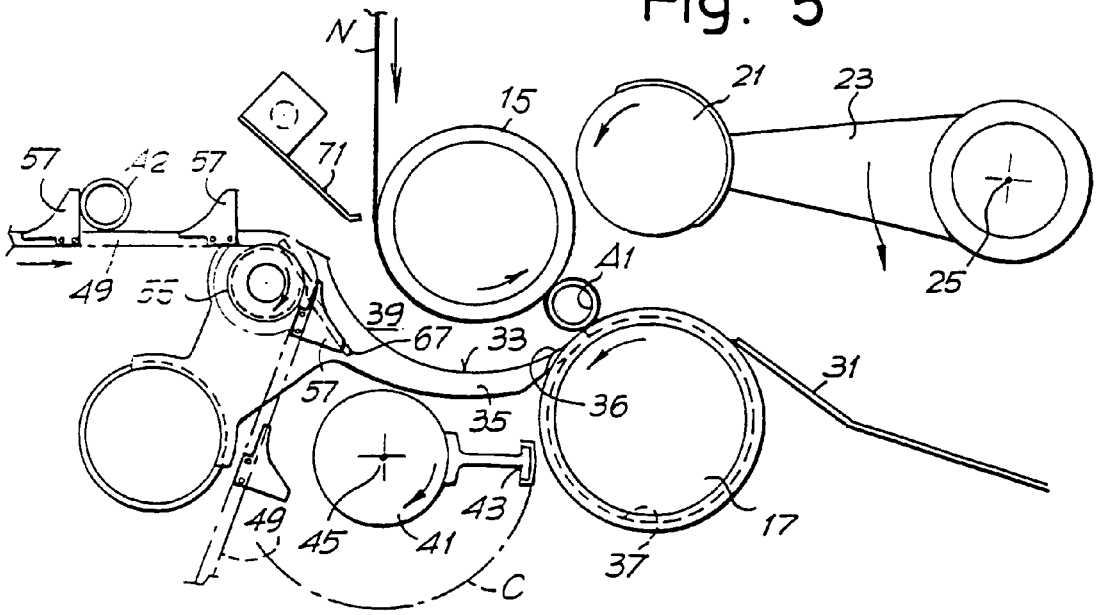

In FIG. 5, the core has left the surface 33 and is in contact with the surfaces of the winder rollers 15 and 17 which, by rotating at slightly different speeds (roller 17 being slower), cause the core to move forward through the nip 19. At the end of its advancement through the nip 19, the core will be located between the three rollers 15, 17 and 21, and the web material N will continue to wind up on the core, some turns thereof having already been wound during the transit of the core through the channel 39 and the nip 19.

Figure 6:
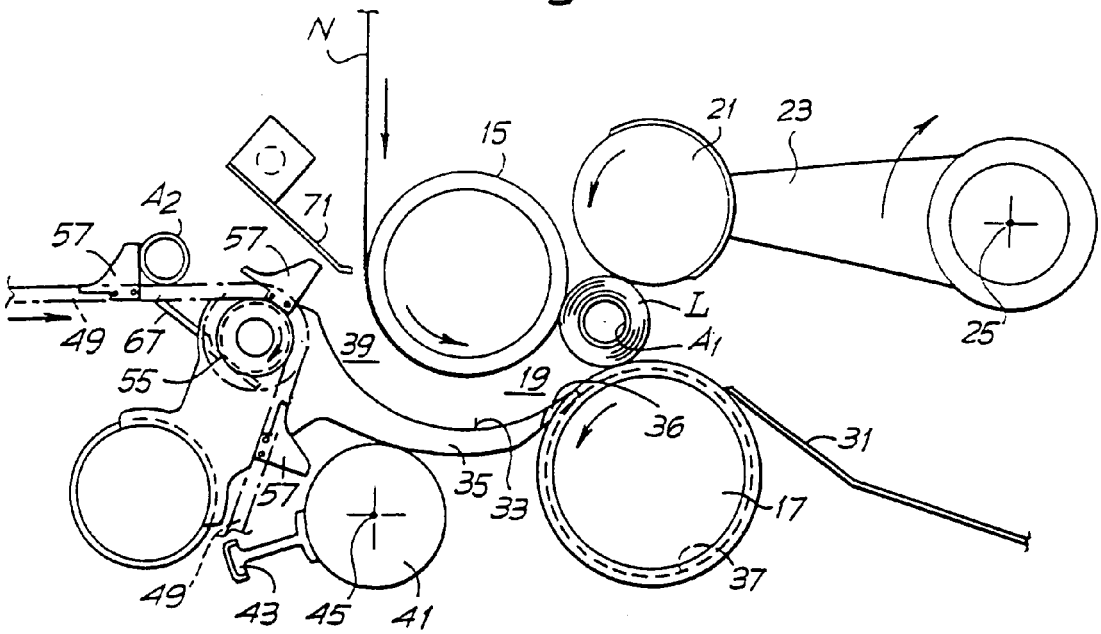
Figure 7:
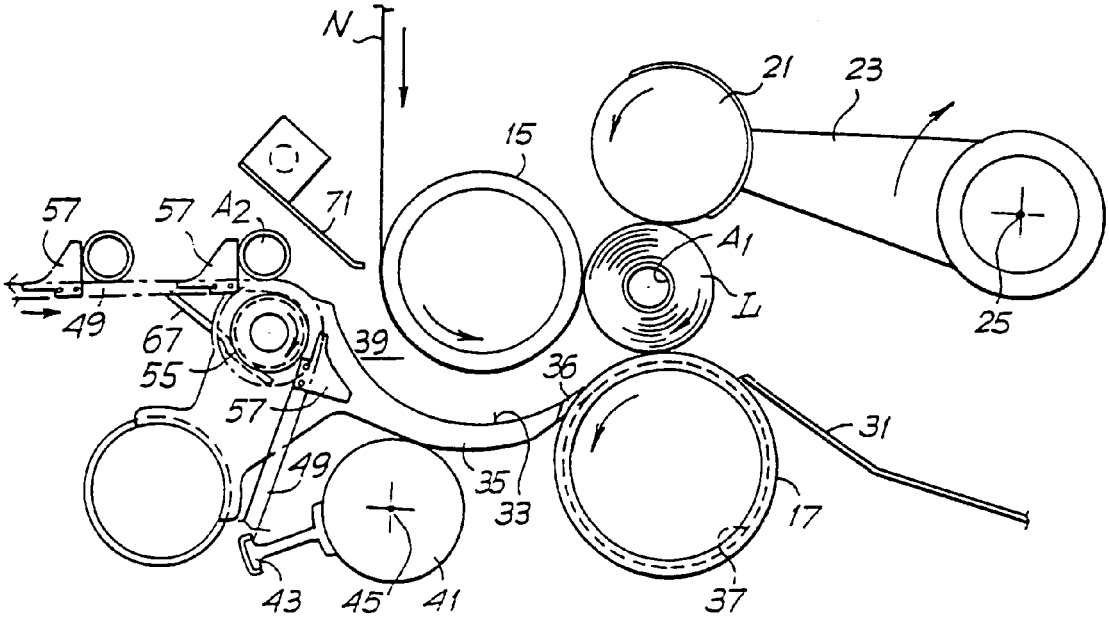

At this time the unit 41 keeps on rotating in clockwise direction until it reaches the position in FIG. 6 where it stops until the next operating cycle. Similarly, the auxiliary pushing member 67, which has continued to rotate simultaneously with the unit 41, is stopped at the angular position shown in FIG. 6.

In this figure, the log L is shown in an intermediate winding step between the rollers 15, 17 and 21, the movable roller 21 being gradually moved upwards to allow the controlled increase of the log. Conversely, the conveyor 47 keeps on moving forward thus bringing the next core A2 to the inlet of channel 39, as can be seen in the next FIG. 7. The conveyor 47 may be provided with either continuous or intermittent motion, also in relation to the rewinder speed.

In case the auxiliary pushing member 67 is not provided, the motion of the conveyor 47 should be in phase with that of the pressers 43 and the relevant rotating unit 41.

Figure 8:
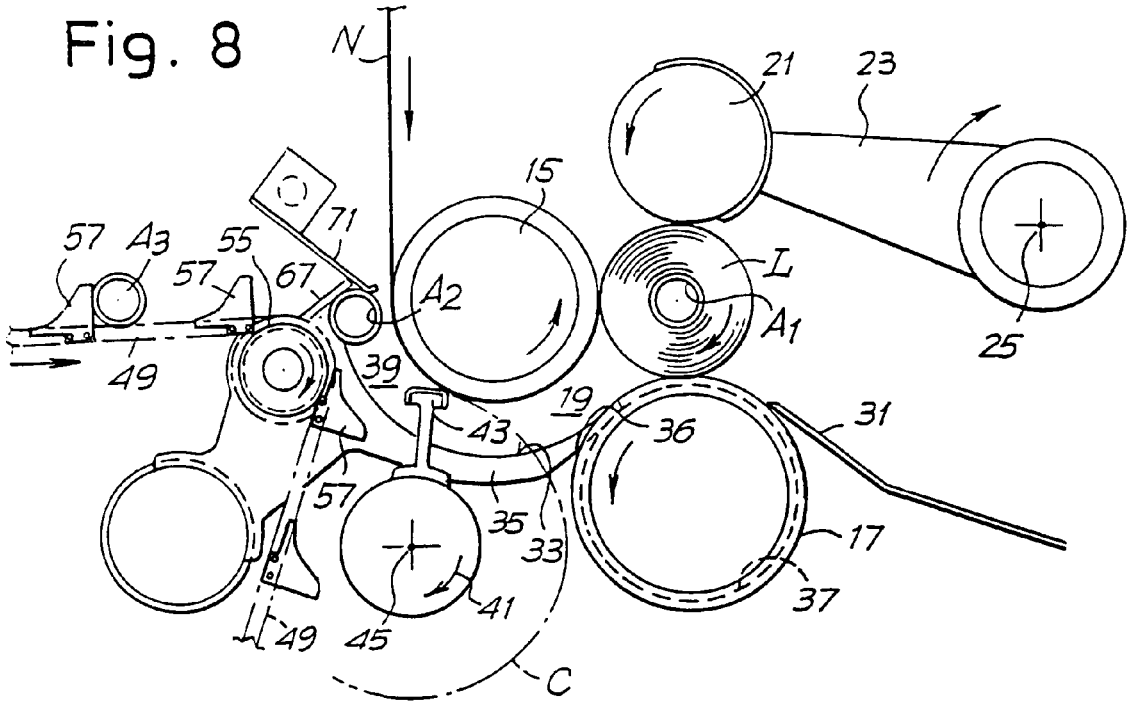

FIG. 8 shows the almost completed log L, the core A2 being brought by the pusher 57 to the inlet of channel 39 and held in that position by a resilient retention finger 71. The latter prevents the core A2 from rolling down and coming in contact with the web material N before the rotary unit 41 is in place.

As the rotary unit 41 and the auxiliary pushing member 67 are advanced, the system takes up the configuration shown in FIG. 8. As can be seen in this Figure, the auxiliary pushing member 67 is about to push the core A2 into the inlet of channel 39, and thus in contact with the web material N, and the pressers 43 are about to come in contact with the surface of the first winder roller 15. The next position is a repeat of the cycle as shown in FIG. 2. FIGS. 2 to 8 illustrate the sequence of operations in which the contact between the new core A1 and the web material N takes place an instant before the material N is torn off, and precisely the moment in which the contact between the pressers 43 and the material N begins.

However, the contact between the core A1 and the web-material N may also be controlled to take place simultaneously with the tear, or with some delay.

In another embodiment of the present invention, the structure of the rewinder remains substantially the same as shown in FIGS. 1 and 2. However, roller 15 and thus web N moves at a speed lower than that of the pressers 43. This speed difference causes the web to separate when the web is pinched between roller 15 and one of pressers 43. The zone of web separation in this embodiment is upstream of pressers 43, between the newly introduced core and pressers 43.

Tearing of the web material by pressers 43 is made easier by the fact that these are provided with a surface with high coefficient of friction, for example, made of rubber, while the corresponding regions of the roller 15 have a low coefficient of friction which facilitates the sliding of the web material on the roller. This arrangement may be as shown, in detail, in FIG. 9. In the annular regions 15A in which the contact of pressers 43 takes place, the roller 15 has a smooth surface. The regions 15A are separated from one another by annular strips 15B having high coefficient of friction, disposed in alignment with the strips 35 and made up, for example, of emery cloth. This material is often employed on rollers to prevent the slipping of the web material.

In this embodiment, since the regions 15A and 15B have annular development, it is possible to have the contact between the roller 15 and the pressers 43 at any point along the periphery of the roller 15. This allows the web material N to be severed at any moment, and thus an amount of web material N (accurately presettable independently of the circumferential development of the roller 5) to be wound on each log.

Instead of presser means, such as those indicated by 43 in FIGS. 1 to 8, severing means of different type may also be used. For example, FIG. 10 shows severing means 43 having sharp, saw-toothed blades 43A which cooperate with annular slots 15C provided in the surface of roller 15. The difference in speed between the blades 43A and the surface of the roller 15 causes the web material to tear. Also, in this case, there is no limitation between the angular position of the roller 15 and the position in which the severing means 43 operate.

FIG. 11 shows, instead, a solution in which the blades 43A cooperate with a longitudinal (i.e., axial) slot 15D formed in the surface of roller 15. According to the difference in speed between the means 43 and the roller surface, the slot 15D is of a size which is sufficient to avoid interference between the two elements. Similarly to the embodiment of FIG. 10, this embodiment has the advantage of avoiding mutual mechanical contact between the severing means and the winder roller 15. However, in the embodiment of FIG. 10, a relation does exist between the angular position of the roller 15 and the position of the severing means 43, 43A. This imposes limits to the machine's versatility. In fact, the length of the web material wound on each log may vary only according to multiples of the circumference of roller 15, unless a mutual sliding between the web material N and the roller 15 is provided during winding of each log, with consequent cyclical rephasing of the position of the slot 15D and severing means 43, 43A.

The embodiments of FIGS. 10 and 11 are particularly suitable in case the rewinder has no perforation group 5. In this case, the rupture of the web material occurs where the serrated and/or sharpened blades are inserted.

In the embodiments of FIGS. 10 and 11, it is possible to operate the severing means 43, 43A at a peripheral speed lower or higher than the speed of movement of the web material. When the severing means 43, 43A operates at a lower speed than that of the web material, severance will take place downstream of the web separator with respect to the direction of web advancement. When the severing means 43, 43A operates at a higher speed than that of the web material, severance will take place upstream of the web separator device, i.e. between the a newly inserted core and severing means 43, 43A.

Further, it is possible to operate the severing means at a peripheral speed equal to that of the web material, thereby reducing the width of channel 15D. In this case, the severance of the web material N is due to the incision thereof and not to a difference in speed.

In case the web material is perforated (as by unit 5), a synchronism must be suitably provided between the action of the severing means 43 and the position of the perforation line, so that the contact between the web material N and the severing means occurs in close proximity to a perforation line with the latter lying immediately downstream of the region of contact. To this end, provision may be made for a control unit, schematically shown at 2, to which data of angular position relative to the position of the cylinder 9 is supplied. The control unit 2 operates an actuator 75 which, as described hereinafter, controls the operation for the severance of the web material, as well as the insertion of the new core and the unloading of the log in synchronism with the position of the perforation line. The same control unit 2 may control the actuator 27 which moves the roller 21 up and down.

Figure 12:
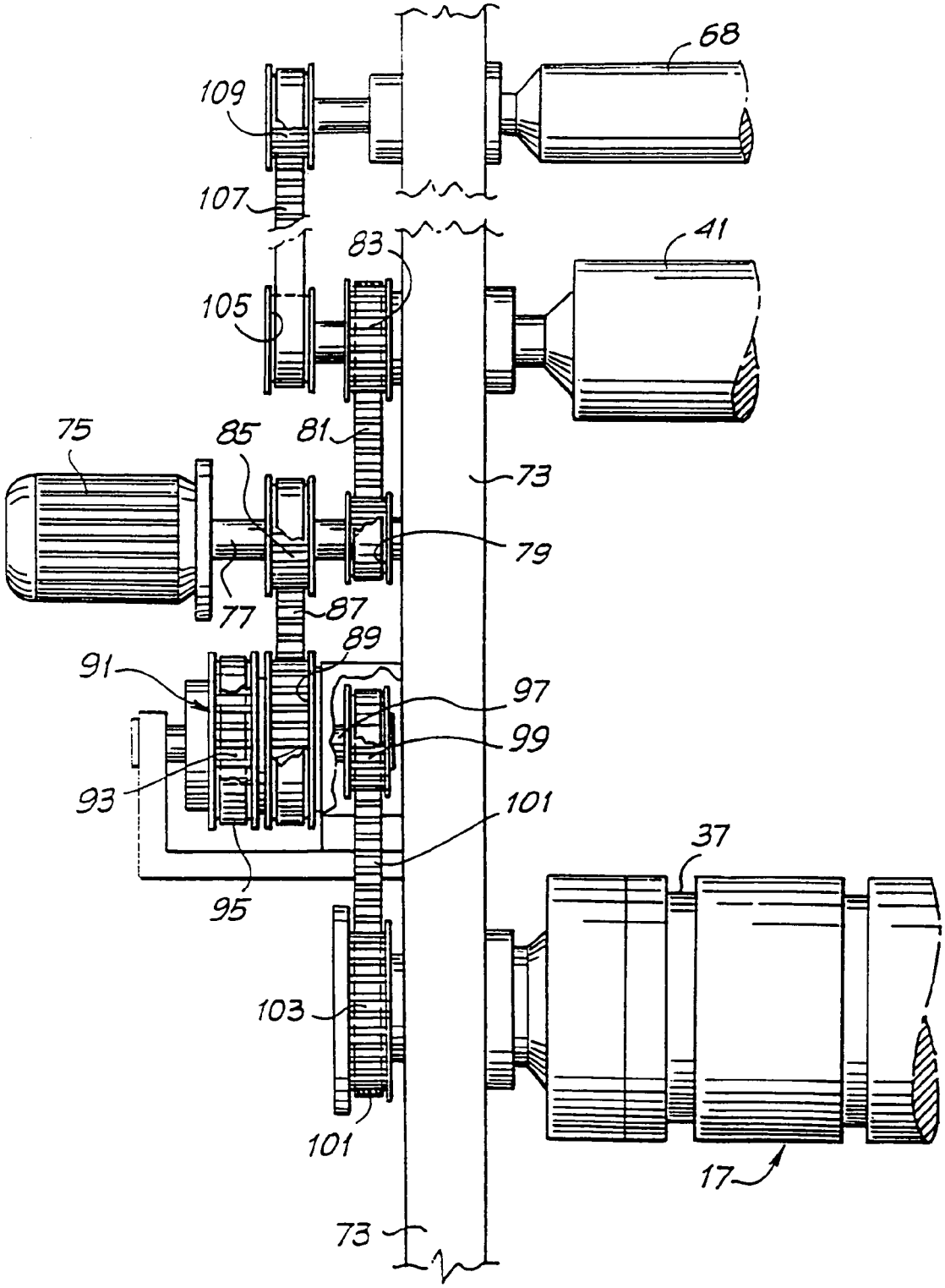
FIG. 12 shows a section taken along line XII-XII in FIG. 1 of one side frame on which the winder rollers and the severing means are supported, to illustrate the transmission for the actuation of the web material severing means and the deceleration of the second winder roller.

FIG. 12 schematically shows a particularly advantageous example of the actuator and the drive means which control the motion of the web material severing means and core insertion means and the deceleration of the winder roller 17.

In FIG. 12, numeral 73 indicates one of the machine's side frame which supports the second winder roller 17, the rotary unit 41, and the cylinder 68 which supports the auxiliary pushing member 67. FIG. 12 is a section taken along line XII-XII of FIG. 1 from which the parts having no significant relation with the description of the means for the actuation of the rotary unit 41 have been taken away.

Numeral 75 indicates a motor serving as actuator of the rotary unit 41. Keyed on the shaft 77 of motor 75 is a first toothed pulley 79 over which a toothed belt 81 is driven, the latter transmitting the motion to the rotary unit 41 via another pulley 83. A second toothed pulley 85, keyed on the shaft 77, transmits the motion, via a toothed belt 87, to a toothed pulley 89. The pulley 89 is keyed on a first input axle of a differential gear generally shown at 91. Fixed to the gear-holding case or box of the differential gear 91 is a pulley 93 on which a belt 95 is driven, the latter taking its motion from a machine member, not shown, rotating at a speed proportional to the feeding speed of the web material N. The member may be any one of the web material guiding and feeding rollers, such as the roller 15. Numeral 97 designates the output axle of the differential gear 91. Keyed on the output axle is a toothed pulley 99 which, through a toothed belt 101, transmits the motion to a toothed pulley 103 keyed on the shaft of the second winder roller 17.

Also keyed on the rotary unit 41 is another pulley 105 which, through a belt 107, transmits the motion to a pulley 109 keyed on the shaft 68 which carries the auxiliary pushing member 67. In the winding stage of the log L between the rollers 15, 17 and 21 (i.e., in the state shown in FIGS. 6 and 7), the motor 75 is at a standstill. The winder roller 17 is rotated directly by belt 95. The transmission ratio of the differential gear and of the pulleys is such as to achieve a peripheral speed of the roller 17 equal to the peripheral speed of the roller 15. When the winding of the log L is almost completed, the motor 75 is rotated. This has the effects of: (a) driving the rotary unit 41 which carries the severing means 43 into rotation; (b) driving the shaft 68 which supports the auxiliary pushing member 67 into rotation; and (c) modifying the transmission ratio between the pulley 93 and the winder roller 17 as a consequence of the rotation of the input axle of the differential 91. The modification of the transmission ratio between the pulley 93 and the roller 17 causes a deceleration of the latter and, therefore, a reduction of its peripheral speed with respect to the peripheral speed of roller 15. This deceleration is sufficient to unload the just-completed log L.

Consequently, a single actuator (motor 75) makes it possible to operate the severance of the web material, the insertion of a new core and the discharge of a completed log, by use of an extremely simple and economical mechanism.

However, different and independent actuators for the various members can be used. Provision may also be made for using a winder roller 17 rotating uniformly at a speed lower than that of roller 15 and for operating the discharge of the completed log L by accelerating the roller 21. This does not change the principle of the invention. When providing an acceleration of the roller 21, this may also have the effect of tensioning the web material N. By suitably phasing, for example, through the control unit 2, the acceleration of roller 21 with the actuation of the severing means 43, it is possible to pre-tension the web material before causing the tearing thereof by the contact between the means 43 and the roller 15.

FIG. 13 shows a modified embodiment in which the channel 39 is not formed by the surface of a first winder roller, but by a separate web feeding means consisting of a plurality of belts 150 driven between a first winder roller 15, and an auxiliary cylinder 152, the belts being suitably spaced apart in the axial direction. Numeral 33 again indicates the surface defining, together with the belt system 150, a channel 39. The second and third winder rollers are again designated 17 and 21, respectively. Numeral 41 indicates the rotary unit carrying the severing means 43 which move through the slits between the strips 35 which define the surface 33. The core insertion means have been omitted in the drawing for the sake of clarity.

Indicated by 154 is a surface which the belts 150 contact. The surface 154 may have a plurality of sliding seats for the belts 154, so that the severing means 43 (consisting of pressers or other means, as described above) act on an almost continuous transverse surface. The surface 154 may be made of a material having low coefficient of friction to facilitate both the sliding of the belts 150 and the tearing of the web material.

The belts 150 are located in alignment with the strips 35 which define the surface 33, and the pressers 43 pass between adjacent belts 150.

As with the other embodiments of the invention, in the embodiments of FIG. 13, it is also possible to operate the severing means 43 at a peripheral speed lower or higher than the speed of movement of the web material. When the severing means 43 operates at a lower speed than the speed of the web material, severance takes place downstream of the web separator with respect to the direction of web advancement. When the severing means 43 operates at a higher speed than the speed of the web material, severance takes place upstream of the web separator, i.e. between a newly inserted core and web separator 43.

Also in this embodiment the interruption means may comprise blade means which cut the web material, in a similar way as provided by the means 43A. The speed of means 43, 43A may also be equal to the speed of the web material N, as the separation thereof is performed by a cutter (means 43A) or a counteracting stationary surface (154).

It is understood that the drawings show an exemplification given only as a practical demonstration of the invention, as this may vary in the forms and dispositions without, nevertheless, coming out from the scope of the idea on which the invention is based. The possible presence of reference numbers in the appended claims has the purpose of facilitating the reading of the claims, reference being made to the description and the drawing, and does not limit the scope of the protection represented by the claims.

It is claimed:

1. An automatic rewinding machine for forming logs of web material wound on cores, said web material having spaced apart lines of perforations, the machine comprising a first winding roller, a second winding roller and a third winding roller; a core inserter; and a web material separator positioned to operate between a point of release of a new core and a position of a nearly completed log, said web material separator periodically pinching said web material between the point of release and said first winding roller when a peripheral speed of said web material separator is less than a speed at which the web material is moving to thereby cause said web material to separate along a line of said lines of perforations at a point in said web material located between said new core and said web material separator, and a core introduction surface on which said new core is introduced comprising a plurality of strips, said web material separator comprising a plurality of web engagement devices spaced apart from each other and constructed and arranged to pass between said strips of the core introduction surface.

2. The automatic rewinding machine according to claim 1, wherein said web engagement devices contact said web material once per log cycle.

3. A rewinding machine comprising a core inserter; a first winding roller around which a web material is moved; a second winding roller; and a third winding roller; the first winding roller, the second winding roller and the third winding roller being arranged to simultaneously contact a log during at least a portion of winding of the web material on a core; and a device constructed and arranged to locally retard the web material and thereby separate the web material at a point in the web material between a newly inserted core and a nearly completed log.

4. A method of winding a web material on a core to form a log, comprising advancing the web material at a speed along a path around a first winding roller and onto a log being wound; introducing a core into a channel formed between the first winding roller and a surface spaced from said first winding roller; and periodically and locally retard the web material to thereby cause the web material to separate at a point in the web material between said core and a nearly completed log.

5. An automatic surface rewinding machine for receiving a web material in continuous motion and for winding the web material on cores to form logs, comprising a first winding roller around which said web material is moved; a second winding roller; and a third winding roller; said first winding roller, said second winding roller and said third winding roller forming a winding cradle and being positioned for simultaneously contacting a log during at least a portion of winding of the web material on a core; a core inserter; and a device which is configured to locally retard the web material and thereby separate the web material at a point in the web material located between a newly inserted core and a nearly completed log.

6. A surface winder for winding a web material on a series of cores comprising a frame defining a web material path having an entering end and a discharge end; a first winding roller on one side of said path adjacent said entering end; a second winding roller on an opposite side of said path spaced downstream from said entering end; a third winding roller on said one side of said path downstream of said first winding roller; a core inserter; a stationary surface on said frame on said opposite side of said path and spaced apart from said first winding roller to form a channel therebetween; said channel being arranged to receive a core from the core inserter and said stationary surface being distanced from said first winding roller such that a core received in the channel contacts said stationary surface and the web material along at least a portion of said path; and a device configured to locally retard the web material and provide tension and thereby separation of the web material at a point in the web material located between said core and a nearly completed log.

7. A surface rewinding machine comprising a core inserter; a first winding roller around which a web material is moved; a second winding roller; and a third winding roller; the first winding roller, the second winding roller and the third winding roller forming a winding cradle and being arranged to simultaneously contact a log during at least a portion of a winding cycle to form a log of said web material on a core; a web separator which is constructed and arranged to periodically act on the web material at an end of each winding cycle and thereby separate the web material at a point in the web material between a newly inserted core and a nearly completed log.

8. A surface winder for winding a web material on a series of cores comprising a frame defining a web material path having an entering end and a discharge end; a first winding roller on one side of said path adjacent said entering end; a second winding roller on an opposite side of said path spaced downstream from said entering end; a third winding roller on said one side of said path downstream of said first winding roller; a core inserter; a stationary surface on said frame on said opposite side of said path and spaced apart from said first winding roller to form a channel therebetween; said channel being arranged to receive a core from the core inserter and said stationary surface being distanced from said first winding roller such that a core received in the channel contacts said stationary surface and the web material along at least a portion of said path; and a device configured to locally contact the web material and provide tension and thereby separation of the web material at a point in the web material located between said core and a nearly completed log.

* * * * *